US008522866B2

(12) United States Patent
Wubben et al.

(10) Patent No.: US 8,522,866 B2
(45) Date of Patent: Sep. 3, 2013

(54) SYSTEM AND METHOD FOR ANCHORING AN EXPANDABLE TUBULAR TO A BOREHOLE WALL

(75) Inventors: Antonius Leonardus Maria Wubben, Kesslerpark (NL); Djurre Hans Zijsling, Kesslerpark (NL)

(73) Assignee: Enventure Global Technology, LLC, Houston, TX (US)

( * ) Notice: Subject to any disclaimer, the term of this patent is extended or adjusted under 35 U.S.C. 154(b) by 63 days.

(21) Appl. No.: 12/869,523

(22) Filed: Aug. 26, 2010

(65) Prior Publication Data

US 2011/0048699 A1 Mar. 3, 2011

Related U.S. Application Data

(60) Provisional application No. 61/237,843, filed on Aug. 28, 2009.

(51) Int. Cl.
*E21B 23/01* (2006.01)

(52) U.S. Cl.
USPC ..... 166/207; 166/216; 166/382

(58) Field of Classification Search
USPC ..... 166/208, 216, 382, 277; 72/208, 72/209, 393
See application file for complete search history.

(56) References Cited

U.S. PATENT DOCUMENTS

| | | | | |
|---|---|---|---|---|
| 4,288,082 | A * | 9/1981 | Setterberg, Jr. | 277/342 |
| 6,827,150 | B2 * | 12/2004 | Luke | 166/387 |
| 6,877,567 | B2 * | 4/2005 | Hirth | 166/382 |
| 7,036,581 | B2 * | 5/2006 | Trahan | 166/186 |
| 7,104,322 | B2 | 9/2006 | Whanger et al. | 166/277 |
| 7,156,182 | B2 * | 1/2007 | Lynde et al. | 166/382 |
| 7,410,001 | B2 * | 8/2008 | Harrall et al. | 166/380 |
| 7,543,639 | B2 * | 6/2009 | Emerson | 166/277 |
| 7,614,449 | B2 * | 11/2009 | Anderson | 166/216 |
| 2004/0244992 | A1 * | 12/2004 | Carter et al. | 166/380 |
| 2006/0000617 | A1 * | 1/2006 | Harrall et al. | 166/380 |
| 2006/0162921 | A1 | 7/2006 | Carmody et al. | 166/217 |
| 2006/0272807 | A1 * | 12/2006 | Adam et al. | 166/207 |
| 2006/0272827 | A1 * | 12/2006 | Adam et al. | 166/380 |
| 2007/0007015 | A1 * | 1/2007 | Thornton | 166/380 |
| 2007/0068671 | A1 * | 3/2007 | Lohbeck | 166/207 |
| 2007/0114019 | A1 * | 5/2007 | Brezinski et al. | 166/207 |
| 2007/0114044 | A1 * | 5/2007 | Brezinski et al. | 166/386 |
| 2007/0158081 | A1 * | 7/2007 | Harrall et al. | 166/380 |
| 2007/0199719 | A1 * | 8/2007 | MacKenzie | 166/380 |
| 2008/0053656 | A1 * | 3/2008 | Lynde | 166/277 |
| 2008/0066927 | A1 * | 3/2008 | Costa et al. | 166/380 |
| 2008/0302543 | A1 * | 12/2008 | O'Connor et al. | 166/387 |
| 2009/0014172 | A1 | 1/2009 | Costa et al. | 166/207 |

* cited by examiner

*Primary Examiner* — Daniel P Stephenson
*Assistant Examiner* — Wei Wang
(74) *Attorney, Agent, or Firm* — Derek V. Forinash; Porter Hedges LLP

(57) ABSTRACT

A system for anchoring an expandable tubular to a borehole wall. The system comprises a support member having a first end fixed relative to the outside of the tubular and a second end comprising a ramping surface. An anchor member has a first end fixed relative to the outside of the tubular and a second end extending toward the support member, the second end being movable relative to the outside of the tubular. The support member includes a ramp surface that tapers in the direction of the anchor member. Expansion of the portion of the expandable tubular between the first support end and the first anchor end causes the axial device length to shorten, wherein the difference in length is sufficient to cause the second anchor end to move radially outward and engage the borehole wall as a result of engagement with the ramping surface.

12 Claims, 1 Drawing Sheet

SYSTEM AND METHOD FOR ANCHORING AN EXPANDABLE TUBULAR TO A BOREHOLE WALL

FIELD OF THE INVENTION

The present invention relates to an expandable assembly for use in a wellbore formed in an earth formation, the assembly comprising a mechanism for increased radial expansion upon expansion. More particularly, the invention relates to a radially expandable device that mechanically engages a borehole wall so as to form an anchor.

BACKGROUND OF THE INVENTION

In the drilling of oil and gas wells, a wellbore is formed using a drill bit that is urged downwardly at a lower end of a drill string. After drilling a predetermined depth, the drill string and bit are removed, and the wellbore is typically lined with a string of steel pipe called casing. The casing provides support to the wellbore and facilitates the isolation of certain areas of the wellbore, for instance adjacent hydrocarbon bearing formations. The casing typically extends down the wellbore from the surface of the well to a designated depth. An annular area is thus defined between the outside of the casing and the earth formation. This annular area is filled with cement to permanently set the casing in the wellbore and to facilitate the isolation of production zones and fluids at different depths within the wellbore.

Expandable tubular elements are finding increasing application in the context of hydrocarbon drilling and production. A main advantage of expandable tubular elements in wellbores relates to the increased available internal diameter downhole for fluid production or for the passage of tools, compared to conventional wellbores with a more traditional nested casing scheme. Generally, an expandable tubular element is installed by lowering the unexpanded tubular element into the wellbore, whereafter an expansion device is pushed, pumped or pulled through the tubular element. The expansion ratio, being the ratio of the diameter after expansion to the diameter before expansion, is determined by the effective diameter of the expander.

When an expandable tubular is run into a wellbore, it must be anchored within the wellbore at the desired depth to prevent movement of the expandable tubular during the expansion process. Anchoring the expandable tubular within the wellbore allows expansion of the length of the expandable tubular into the wellbore by an expander tool. The anchor must provide adequate engagement between the expandable tubular and the inner diameter of the wellbore to stabilize the expandable tubular against rotational and longitudinal axial movement within the wellbore during the expansion process.

The expandable tubular is often run into the wellbore after previous strings of casing are already set within the wellbore. The expandable tubular must be run through the inner diameter of the previous strings of casing to reach the portion of the open hole wellbore slated for isolation, which is located below the previously set strings of casing. Accordingly, the outer diameter of the anchor and the expandable tubular must be smaller than all previous casing strings lining the wellbore in order to run through the liner to the depth at which the open hole wellbore exists.

Additionally, once the expandable tubular reaches the open hole portion of the wellbore below the previous casing or liner, the inner diameter of the open hole portion of the wellbore is often larger than the inner diameter of the previous casing. To hold the expandable tubular in place within the open hole portion of the wellbore, the anchor must have a large enough outer diameter to sufficiently fix the expandable tubular at a position within the open hole wellbore before continuing with the expansion process.

U.S. Pat. No. 7,104,322 discloses a method and apparatus for anchoring an expandable tubular within a wellbore. The apparatus includes a deployment system comprising an inflatable packing element. The packing is arranged inside the liner and is supported on the drill string. When inflated, the packing radially expands an anchoring portion of the expandable tubular. The outside of the anchoring portion engages the wellbore wall and forms an anchor. The remainder of the expandable tubular can subsequently be expanded using an expander tool. The holding power and shape of the anchoring portion may be manipulated by altering the characteristics of the packer such as the shape and wall thickness of the packer.

However, engagement of the tubular with the formation, as disclosed in U.S. Pat. No. 7,104,322, is limited by the amount of expansion of the tubular element, which is typically constrained by the mechanical limits of the expansion device. For instance in cases where the annulus between the unexpanded tubular and the borehole wall is relatively large, the amount of available mechanical expansion may not be sufficient to cause the expanded tubular to engage the borehole wall.

In addition, although the friction between the outside of the tubular and the wellbore wall that keeps the expandable tubular in position may withstand the reactive forces induced on the expandable tubular by a rotational expansion tool, the friction may be insufficient to withstand the reactive force when pulling an expander cone through the expandable tubular. If the friction is insufficient, the expansion tool may move the expandable element in axial direction during expansion, and the unexpanded tubular may obstruct the previous casing. The unexpanded element must then be removed, at considerable costs, or the obstruction may render the wellbore useless, at even greater expense.

Thus, it remains desirable to provide a device that will mechanically engage the borehole wall upon expansion of a tubular, even in instances where the expanded tubular does not itself engage the borehole wall.

SUMMARY OF THE INVENTION

The present invention provides a tubing-mounted device that will mechanically engage a borehole wall upon expansion of a tubular, even in instances where the expanded tubular does not itself engage the borehole wall.

A system according to the invention for anchoring an expandable tubular to a borehole wall, comprises a support member having a first end fixed relative to the outside of the tubular; and an anchor member having a first end fixed relative to the outside of the tubular and a second end extending toward the support member, said second end being movable relative to the outside of the tubular; said support member including a ramp surface that tapers in the direction of said anchor member; said first anchor end and said first support end defining an initial axial device length $L_1$ therebetween; wherein $L_1$ is selected such that expansion of the portion of the expandable tubular between the first support end and the first anchor end causes the axial device length to shorten to $L_2$, wherein the difference between $L_1$ and $L_2$ is sufficient to cause the second anchor end to move radially outward and engage the borehole wall as a result of engagement with said ramp surface.

BRIEF DESCRIPTION OF THE DRAWINGS

The present invention is better understood by reading the following description of non-limitative embodiments with reference to the attached drawings, wherein like parts of each of the figures are identified by the same reference characters, and which are briefly described as follows.

DETAILED DESCRIPTION OF THE INVENTION

Figure 1:
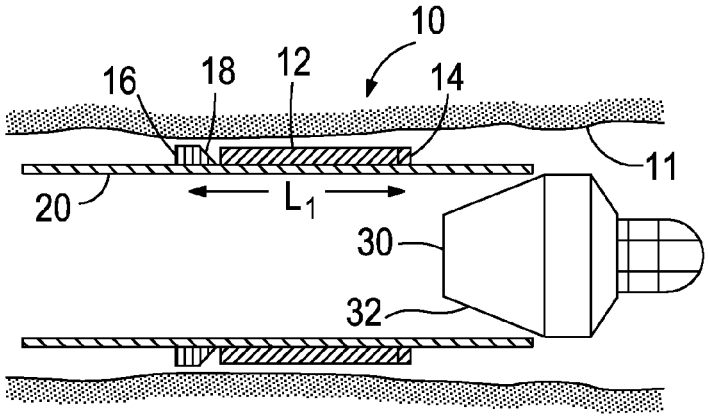
FIG. 1 is a schematic cross-section of a first embodiment of the invention positioned in a borehole before being expanded.

FIG. 1 shows an expandable anchoring device 10 for anchoring an expandable tubular 20 to a borehole wall 11 constructed in accordance with a first embodiment of the present invention. The anchoring device 10 comprises an anchor 12 and a wedging member 16 both mounted on the outside of an expandable tubular 20 and separated by a first distance $L_1$. The expandable tubular 20 may include a single tubular element, or any number of interconnected tubular elements. The tubular elements can be interconnected using threaded connections known in the art (not shown). Anchor 12 includes a fixed end 14 that is preferably affixed to tubular 20 by welding or other means that prevents relative movement between fixed end 14 and tubular 20. The other end of anchor 12 extends toward wedging member 16 but is not affixed to the outside of tubular 20, so that all of anchor 12 except fixed end 14 is free to move relative to tubular 20. Anchor 12 may be constructed such that its inner diameter is the same as or, more preferably, greater than the unexpanded outside diameter of tubular 20.

It will be understood that anchor 12 and fixed end 14 can be formed as a single, integral component, constructed from separate pieces that have been joined, or comprise separate pieces that are not mechanically joined. It is preferred that at least fixed end 14 be affixed to tubular 20, preferably but not necessarily by welding.

Similarly, wedging member 16 is preferably affixed to tubular 20 by welding or other means that prevents relative movement therebetween. Wedging member 16 includes a ramp member 18 that extends toward anchor 12. Ramp 18 may be constructed with any desired surface angle.

The thicknesses of wedging member 16 and anchor 12 are a matter of design, but are limited by the maximum allowable diameter of the system prior to expansion, which is smaller than the inner diameter of the previous casing string.

Anchor 12 and wedging member 16 can each have either an annular or segmented construction. In a segmented construction, anchor 12 and/or wedging member 16 may comprise longitudinal strips, rods, or plates. For example, eight strips, each extending around 45 degrees or less of the outer circumference of tubular 20 could be used. Alternatively, anchor 12 and/or wedging member 16 may include both an annular portion and a segmented portion. In the latter case, it is preferred that the annular portion lie outside of the separation distance $L_1$.

It is further preferred that any fixed end and/or annular portion be made from a ductile material and have sufficient thickness and length that it can be expanded without requiring undue force. A suitable ductile material is for instance carbon steel A333. The material has for instance a modulus of elasticity with respect to tension in the order of 30 or more and with respect to torsion in the order of 11 or more.

Expandable anchoring device 10 is intended for use in conjunction with an expandable tubular 20, which in turn is expanded by an expansion device 30. As illustrated, expansion device 30 may comprise a cone having a frustoconical expansion surface 32 that increases the inside diameter of tubular 20 as expansion device 30 is pushed or pulled through tubular 20, but it will be understood that expansion device 30 can comprise any suitable mechanism for applying a radial expansion force to the inside of tubular 20.

Figure 2:
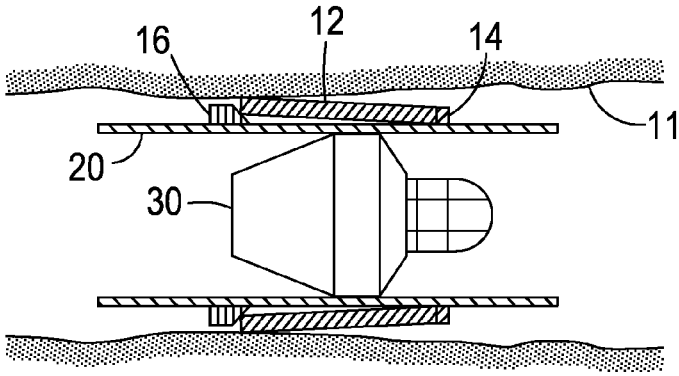
FIG. 2 is a cross-sectional view of the device of FIG. 1 in an intermediate level of expansion.
Figure 3:
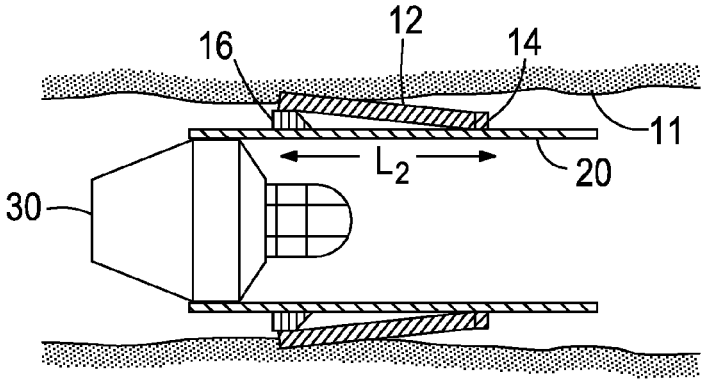
FIG. 3 is a cross-sectional view of the device of FIG. 1 fully expanded within the borehole.

Referring to FIGS. 2 and 3, it can be seen that as expansion device 30 moves through tubular 20, tubular 20 shortens. Thus, as expansion device 30 moves from one end of $L_1$ to the other; the distance between wedging member 16 and fixed end 14 of anchor 12 decreases. The final distance between wedging member 16 and fixed end 14 of anchor 12 is reached once expansion device 30 has moved past wedging member 16, and is defined as $L_2$. Because anchor 12 is not affixed to tubular 20 apart from fixed end 14, the shortening of tubular 20 has virtually no effect on the length of anchor 12.

For a given tubular and expansion ratio, the amount of shortening that will occur if the tubular is not constrained during expansion can be predicted. In a preferred embodiment, the distance $L_1$ is selected such that the amount of shortening, which can be expressed as the difference between $L_1$ and $L_2$, is sufficient to cause the anchor 12 to overlap wedging member 16 by a desired longitudinal distance. The difference between $L_1$ and $L_2$ is a function of the expansion ratio, the expansion mode and, less so, of the original tubing wall thickness and can be predicted on the basis of those parameters.

As used herein, "expansion mode" distinguishes between so-called expansion in tension and expansion in compression, which in turn are used to describe stress states experienced by the tubular during expansion. During expansion in tension, the expansion device moves away from a location where the expandable tubular is fixed, which is for instance the position of an anchor. During expansion in compression the expansion device moves towards the location where the expandable tubular is fixed. The expandable tubular shortens approximately two times more during expansion in compression, than during expansion in tension. Shortening herein indicates the difference in length of (a section of) the tubular before and after expansion. During expansion of the tubular, the mode of expansion may change. In addition, the weight of the expandable tubular may introduce a second order effect. However, in general the mode of expansion is known, as is described in more detail below. Thus, it is possible and desirable to calculate and use a predetermined spacing $L_1$ that will result in a desired overlap and outward movement of anchor 12.

During expansion of the expandable tubular element according to the present invention, the section of the tubular that is provided with the anchor of the invention is preferably expanded in a first step. During this first step, gripping means hold the unexpanded tubular element in a predetermined position until the anchor engages the wellbore wall. Suitable gripping means that operate in conjunction with an expansion device are for instance disclosed in US-2009/0014172-A1, which is in this respect incorporated herein by reference. In a first expansion step, the gripping means engage the wall of the tubular. Than, an actuator, including for instance a hydraulic actuator, pulls the expansion device through the tubular until the anchor is activated. In a subsequent step, once the anchor has engaged the borehole wall, the remainder of the tubular element can be expanded by pulling the expansion device toward the surface. Expansion by pulling the expander toward the surface is relatively fast compared to other ways of expansion. Expansion using the gripper system can be nominated expansion in compression, wherein pulling the expander to the surface when the anchor is activated is called expansion in tension. Thus, the mode of expansion may change when the anchor is activated and engages the borehole wall.

As an alternative to the gripping system, the string of expandable tubular elements 20 can be closed at its downhole (not shown), forming a closed fluid pressure chamber between the closed end and the expansion device 30. I.e., the downhole end is closed at surface, before introducing the expandable tubular including the closed end and the expansion device in the wellbore. The expansion device 30 will be provided with a fluid passage connecting the top and bottom end thereof. For instance tubing of a hollow pipe string is connected to the top end of the fluid passage, to pass fluid under pressure from surface and through the expansion device into the fluid pressure chamber, wherein the resulting pressure in the fluid chamber pushes the expansion device through the expandable tubular. Expansion using a pressure chamber under the expansion device is called expansion in tension.

The expansion process of the expandable liner 20 actuates the anchoring device of the present invention. Due to the shortening of the liner as the expansion device moves from one end of $L_1$ to the other, the anchor 12 slides onto the ramp 18 of the wedging member 16. In the absence of hinges, the free end of the anchor may overlap the wedging member 16 by a desired longitudinal distance. The length of the overlap is preferably minimized, in order to limit the increase in expansion force.

The free end of the anchor focuses the radial force that the anchor exerts on the formation during expansion of the liner 20 on the surface of the free end. Thus, the radial force that will be exerted per area of the formation increases. The local resistance or strength of the formation may be expressed as a resistive force per area (e.g. in units psi or Pa). The formation resistance within the wellbore may range between 500 psi up to 16000 psi, and can for instance be measured or estimated. This allows the contact area between the formation and the free end, as well as the corresponding maximum radial force on the tip to be designed such that the tip will penetrate over a predetermined minimum penetration depth into the formation during expansion of the tubular element.

The maximum anchoring force is for instance determined by one or more of the strength of the formation in conjunction with the contact area between the anchors and the formation perpendicular to the axis of the tubular, the penetration depth, the number of anchors disposed around the circumference of the tubular element, etc.

For a tubular element having an external diameter of 9⅝ inch, the anchor and/or wedging members may have a thickness in the range of 0.3 to 1 inch (1 to 2.5 cm), for instance about 0.5 inch (1.2 cm). The ramp may typically have an angle with respect to the axis of the tubular element in the order of 30 to 60 degrees, for instance about 45 degrees. The overlap is for instance 0.5 to 2 inch (1 to 5 cm). The length of the anchor may be in the range of 3 to 16 inch (7.5 to 40 cm).

The anchoring device of the invention can be scaled up or down to match any size of expandable tubular element that is commonly used when drilling for hydrocarbons. The force that is required to expand the expandable tubular element may increase locally for instance about 5% to 50% along the length of the anchoring member of the invention. At the position of the ramp member, the expansion force may increase about 20% to 40% when the free end of the anchor 12 engages the formation.

All exemplary sizes and shapes provided above could be scaled and adapted to the external diameter of any expandable tubular element that is typically used for the exploration and production of hydrocarbons.

The present invention is not limited to the above-described embodiments thereof, wherein many modifications are conceivable within the scope of the appended claims Features of respective embodiments can for instance be combined.

What is claimed is:

1. A system for anchoring an expandable tubular to a borehole wall, comprising:

a support member having a first end fixed relative to the outside of the expandable tubular; and an anchor member having a first anchor end fixed relative to the outside of the expandable tubular and a second anchor end extending toward the support member, said second anchor end being movable relative to the outside of the expandable tubular;

said support member including a ramp surface that tapers in the direction of said anchor member;

said first anchor end and said first support end defining an initial axial device length ($L_1$) therebetween;

wherein the initial axial device length ($L_1$) is selected such that expansion of the portion of the expandable tubular between the first support end and the first anchor end causes the axial device length to shorten to a final axial device length ($L_2$), wherein the difference between the initial axial device length ($L_1$) and the final axial device length ($L_2$) is sufficient to cause the second anchor end to move radially outward and engage the borehole wall as a result of engagement with said ramp surface while the first anchor end remains fixed relative to the outside of the expandable tubular.

2. The system according to claim 1 wherein the anchor member is annular.

3. The system according to claim 1 wherein the support member is annular.

4. The system according to claim 1 wherein the ramp surface defines an angle of between 30 and 60 degrees with the axis of the expandable tubular.

5. A system for anchoring an expandable tubular to a borehole wall, comprising:

a support member fixed relative to the outside of the expandable tubular and having a ramp surface; and an anchor member having a first anchor end fixed relative to the outside of the expandable tubular and a second anchor end extending toward the ramp surface of the support member, wherein the first anchor end is disposed at an initial separation distance from the support member;

wherein the initial separation distance is selected such that expansion of the portion of the expandable tubular between the support member and the first anchor end causes the initial separation distance to shorten to a final separation distance, wherein the difference between the initial separation distance and the final separation distance is sufficient to cause the second anchor end to engage the ramp surface and move radially outward so as to engage the borehole wall while the first anchor end remains fixed relative to the outside of the expandable tubular.

6. The system according to claim 5 wherein the anchor member is annular.

7. The system according to claim 5 wherein the support member is annular.

8. The system according to claim 5 wherein the ramp surface defines an angle of between 30 and 60 degrees with the axis of the expandable tubular.

9. A method for anchoring an expandable tubular to a borehole wall comprising:

fixably coupling a support member to an expandable tubular;

fixably coupling a first end of an anchor member to the expandable tubular at a separation distance from the support member, wherein the anchor member has a second end that extends toward a ramp surface of the support member;

disposing the expandable tubular in a borehole having a borehole wall; and radially expanding the expandable tubular so as to reduce the separation distance, wherein as the separation distance is reduced, the second end of the anchor member is deflected outward and into engagement with the borehole wall while the first end of the anchor member remains fixably coupled to the expandable tubular, wherein the second end of the anchor member is deflected outward as a result of the anchor member moving axially along the ramp surface as the separation distance is reduced.

10. The method according to claim 9 wherein the anchor member is annular.

11. The method according to claim 9 wherein the support member is annular.

12. The method according to claim 9 wherein the ramp surface defines an angle of between 30 and 60 degrees with the axis of the expandable tubular.

* * * * *